US009038901B2

(12) United States Patent
Paterson et al.

(10) Patent No.: US 9,038,901 B2
(45) Date of Patent: May 26, 2015

(54) OPTICAL DEVICE HAVING WINDAGE MEASUREMENT INSTRUMENTS

(71) Applicant: BURRIS COMPANY, INC., Greeley, CO (US)

(72) Inventors: Douglas F. Paterson, Priest River, ID (US); Steven A. Bennetts, Greeley, CO (US)

(73) Assignee: Burris Company, Inc., Greeley, CO (US)

( * ) Notice: Subject to any disclaimer, the term of this patent is extended or adjusted under 35 U.S.C. 154(b) by 0 days.

(21) Appl. No.: 13/762,702

(22) Filed: Feb. 8, 2013

(65) Prior Publication Data

US 2013/0206836 A1 Aug. 15, 2013

Related U.S. Application Data

(60) Provisional application No. 61/599,203, filed on Feb. 15, 2012.

(51) Int. Cl.

| | |
|---|---|
| ***G06G 7/80*** | (2006.01) |
| ***F41G 3/08*** | (2006.01) |
| ***F41G 3/06*** | (2006.01) |

(52) U.S. Cl.
CPC ... *F41G 3/08* (2013.01); *F41G 3/06* (2013.01)

(58) Field of Classification Search
USPC ..... 235/404, 407, 411–413, 400
See application file for complete search history.

(56) References Cited

U.S. PATENT DOCUMENTS

| | | | |
|---|---|---|---|
| 722,910 | A | 3/1903 | Saegmuller |
| 2,381,101 | A | 8/1945 | Bausch |
| 3,153,856 | A | 10/1964 | Felix |
| 3,183,594 | A | 5/1965 | Panunzi |
| 3,315,362 | A | 4/1967 | Palmer |
| 3,611,606 | A | 10/1971 | Sefried et al. |
| 3,669,523 | A | 6/1972 | Edwards |
| D234,539 | S | 3/1975 | Marchetti |
| D234,540 | S | 3/1975 | Marchetti |
| 3,877,166 | A | 4/1975 | Ward |
| 3,994,597 | A | 11/1976 | Calder et al. |
| 4,264,123 | A | 4/1981 | Mabie |
| 4,523,818 | A | 6/1985 | Lang et al. |
| 4,531,052 | A | 7/1985 | Moore |
| 4,571,870 | A | 2/1986 | Heideman et al. |
| 4,630,903 | A | 12/1986 | Jones |
| 4,643,542 | A | 2/1987 | Gibson |

(Continued)

FOREIGN PATENT DOCUMENTS

| | | |
|---|---|---|
| WO | WO 00/50836 | 8/2000 |
| WO | WO 03/096216 | 11/2003 |

OTHER PUBLICATIONS

PCT International Search Report and Written Opinion in International Application PCT/US2013/026373, mailed Apr. 19, 2013, 13 pgs.

*Primary Examiner* — Kristy A Haupt

(57) ABSTRACT

An optical device includes a housing containing a plurality of lenses. At least one of those lenses includes a reticle. An optical device and a processor are also located in the housing. A wind speed sensor is mounted to the housing and configured to send a wind speed signal corresponding to a wind speed to the processor. The processor calculates a wind speed based at least in part on the wind speed signal, and wherein the processor sends an output signal corresponding to the calculated wind speed to the output device.

18 Claims, 6 Drawing Sheets

(56) References Cited

U.S. PATENT DOCUMENTS

| | | | |
|---|---|---|---|
| 4,695,161 | A | 9/1987 | Reed |
| 4,777,754 | A | 10/1988 | Reynolds, Jr. |
| 4,845,871 | A | 7/1989 | Swan |
| 5,343,744 | A | 9/1994 | Ammann |
| 5,400,540 | A | 3/1995 | Solinsky et al. |
| 5,408,359 | A | 4/1995 | Ferrett et al. |
| 5,426,880 | A | 6/1995 | Ruger et al. |
| 5,430,967 | A | 7/1995 | Woodman, III et al. |
| 5,506,727 | A | 4/1996 | Douglas et al. |
| 5,584,137 | A | 12/1996 | Teetzel |
| 5,771,623 | A | 6/1998 | Pernstich et al. |
| 5,783,745 | A | 7/1998 | Bergman |
| 5,784,207 | A | 7/1998 | Satoh |
| 5,920,995 | A | 7/1999 | Sammut |
| 5,941,489 | A | 8/1999 | Fanelli et al. |
| 5,973,315 | A | 10/1999 | Saldana et al. |
| 6,032,374 | A | 3/2000 | Sammut |
| 6,185,854 | B1 | 2/2001 | Solinsky et al. |
| 6,269,581 | B1 | 8/2001 | Groh |
| 6,363,223 | B1 | 3/2002 | Gordon |
| 6,442,883 | B1 | 9/2002 | Waterman et al. |
| 6,453,595 | B1 | 9/2002 | Sammut |
| 6,516,551 | B2 | 2/2003 | Gaber |
| 6,516,699 | B2 | 2/2003 | Sammut et al. |
| 6,574,901 | B1 | 6/2003 | Solinsky et al. |
| 6,580,555 | B2 | 6/2003 | Crista |
| 6,580,876 | B1 | 6/2003 | Gordon |
| 6,606,813 | B1 | 8/2003 | Squire et al. |
| 6,608,298 | B2 | 8/2003 | Gaber |
| 6,615,531 | B1 | 9/2003 | Holmberg |
| 6,681,512 | B2 | 1/2004 | Sammut |
| 6,721,095 | B2 | 4/2004 | Huber |
| 6,729,062 | B2 | 5/2004 | Thomas et al. |
| 6,792,206 | B2 | 9/2004 | Gordon |
| 6,807,742 | B2 | 10/2004 | Schick et al. |
| 6,813,025 | B2 | 11/2004 | Edwards |
| 6,819,495 | B2 | 11/2004 | Shani et al. |
| 6,862,832 | B2 | 3/2005 | Barrett |
| 7,125,126 | B2 | 10/2006 | Yamamoto |
| 7,129,857 | B1 | 10/2006 | Spirkovska |
| 7,292,262 | B2 | 11/2007 | Towery et al. |
| 7,317,520 | B2 | 1/2008 | Wang et al. |
| 7,343,707 | B2 | 3/2008 | Smith, III |
| 7,703,679 | B1 | 4/2010 | Bennetts et al. |
| 8,201,741 | B2 | 6/2012 | Bennetts et al. |
| 8,353,454 | B2 | 1/2013 | Sammut et al. |
| 2002/0089752 | A1 | 7/2002 | Morgan, III |
| 2003/0010190 | A1 | 1/2003 | Sammut et al. |
| 2003/0163278 | A1 | 8/2003 | Clark et al. |
| 2004/0047586 | A1 | 3/2004 | Schick et al. |
| 2004/0068913 | A1 | 4/2004 | Solinsky et al. |
| 2004/0082888 | A1 | 4/2004 | Palazzolo et al. |
| 2004/0088898 | A1 | 5/2004 | Barrett |
| 2004/0144013 | A1 | 7/2004 | Leatherwood |
| 2004/0187374 | A2 | 9/2004 | Solinsky et al. |
| 2004/0231220 | A1 | 11/2004 | McCormick |
| 2004/0234812 | A1 | 11/2004 | Naito et al. |
| 2005/0002668 | A1 | 1/2005 | Gordon |
| 2005/0021282 | A1 | 1/2005 | Sammut et al. |
| 2005/0036109 | A1 | 2/2005 | Blum et al. |
| 2005/0200959 | A1 | 9/2005 | Yamamoto |
| 2005/0219690 | A1 | 10/2005 | Lin et al. |
| 2005/0252062 | A1 | 11/2005 | Scrogin et al. |
| 2006/0010760 | A1 | 1/2006 | Perkins et al. |
| 2006/0162226 | A1 | 7/2006 | Tai |
| 2006/0164704 | A1 | 7/2006 | Sieczka et al. |
| 2007/0035824 | A1 | 2/2007 | Scholz |
| 2007/0086893 | A1 | 4/2007 | Pedersen |
| 2007/0097351 | A1 | 5/2007 | York et al. |
| 2007/0234626 | A1 | 10/2007 | Murdock et al. |
| 2007/0277421 | A1 | 12/2007 | Perkins et al. |
| 2008/0186568 | A1 | 8/2008 | Chen et al. |
| 2009/0266892 | A1 | 10/2009 | Windauer et al. |
| 2011/0075125 | A1 | 3/2011 | Kanayama |
| 2012/0044475 | A1 | 2/2012 | Yang et al. |
| 2012/0048931 | A1 | 3/2012 | Arbouw |
| 2012/0097741 | A1 | 4/2012 | Karcher |
| 2012/0182417 | A1 | 7/2012 | Everett |
| 2012/0186130 | A1 | 7/2012 | Tubb |
| 2012/0298750 | A1 | 11/2012 | McCarty et al. |
| 2013/0033746 | A1 | 2/2013 | Brumfield |
| 2013/0040268 | A1 | 2/2013 | Van Der Walt et al. |
| 2013/0047485 | A1 | 2/2013 | Tubb |
| 2013/0188180 | A1 | 7/2013 | Jakob |
| 2013/0199074 | A1 | 8/2013 | Paterson et al. |
| 2014/0319215 | A1 | 10/2014 | Farca et al. |

OPTICAL DEVICE HAVING WINDAGE MEASUREMENT INSTRUMENTS

CROSS-REFERENCE TO RELATED APPLICATIONS

This application claims priority to and the benefit of U.S. Provisional Patent Application Ser. No. 61/599,203, filed Feb. 15, 2012, entitled "Optical Device Having Windage Measurement Instruments," the entire disclosure of which is hereby incorporated by reference herein in its entirety.

INTRODUCTION

Various scope sighting systems (also referred to as optical devices or sights), for rifles, pistols, or other firearms are known in the art. In general, these include a plano containing a reticle located between an objective lens and an ocular lens. Additionally, an erector lens assembly is located between the objective and ocular lenses. The erector lens assembly may be movable to allow adjustable sighting of targets are various magnifications. The erector lens assembly allows targets a considerable distance from the rifleman to be viewed more easily through the scope, resulting in more accurate shots. Although the technology of riflescopes has improved over the years, a number of shortcomings are still present with even the most advanced riflescopes.

A number of factors must be considered to accurately sight a target. Range to target is one factor. This is typically determined using a laser range-finding device, either separate from or integral with the optical device. Additionally, ballistic information for the particular firearm and munitions used are considered. In advanced electronic optical devices, this information is often programmed into a processor located within the optical device. Other factors that should be considered include elevation (lower barometric pressure effect bullet flight), distance of the shooter above or below the target, and wind speed and direction. With regard to wind speed, the rifleman must typically estimate wind speed at his location or may utilize a wind gauge separate from the optical device. Typically, a single rifleman cannot use a wind gauge and maintain a view of a target. This requires an additional hunter (often referred to as a spotter), or the rifleman must try to estimate the wind based on experience, previously obtained weather data, etc.

SUMMARY

In one aspect, the technology relates to an optical device including: a housing containing a plurality of lenses, wherein at least one of the lenses includes a reticle; an output device; a processor located in the housing; and a wind speed sensor mounted to the housing and configured to send a wind speed signal corresponding to a wind speed to the processor; wherein the processor calculates a wind speed based at least in part on the wind speed signal, and wherein the processor sends an output signal corresponding to the calculated wind speed to the output device. In an embodiment, the output device includes an addressable display and the output signal includes a display signal including at least one of a numerical value and an aiming point. In another embodiment, the wind speed sensor includes an anemometer. In yet another embodiment, the anemometer includes at least one of a velocity anemometer, pressure sensor, a cup anemometer, a wind vane anemometer, a hot wire anemometer, a laser Doppler anemometer, a Doppler LIDAR anemometer, a sonic anemometer, and a tube anemometer. In still another embodiment, the device includes a wind direction sensor.

In another embodiment of the above aspect, the wind speed sensor includes a microphone array. In another embodiment, the array includes at least two microphone elements, each microphone element including a speaker element and a pickup element. In an embodiment, the speaker element is acoustically isolated from the pickup element. In yet another embodiment, the microphone array delivers a sound having a frequency outside the audible range of a non-human animal. In still another embodiment, microphone array emits a sound signal having at least one of a frequency characteristic and a pulse characteristic that each reduce noise. In another embodiment, the microphone array includes: a speaker element; a first pickup element; and a second pickup element, wherein the first pickup element and the second pickup element are acoustically isolated from the speaker element, and wherein the speaker element emits a single sound signal, and wherein the first pickup element and the second pickup element each receive the single sound signal, and wherein the processor calculates a wind speed and direction based at least in part on that single sound signal.

In another aspect, the technology relates to an optical device including: a housing containing a plurality of lenses, wherein at least one of the lenses includes an addressable element; a processor located in the housing; and a wind speed sensor mounted to the housing and configured to send a wind speed signal corresponding to a wind speed to the processor; wherein the processor calculates a wind speed based at least in part on the wind speed signal, and wherein the processor sends an address signal to the addressable element. In an embodiment, the processor averages a plurality of calculated wind speeds over a time to determine an average wind speed. In another embodiment, the average wind speed is weighted over the time in favor of recent measurements. In yet another embodiment, the device measures a wind gust speed and a wind variation severity. In still another embodiment, the processor stores a wind speed and a time associated with the wind speed.

In another embodiment the device includes a directional sensor for detecting a gun orientation, wherein the wind speed sensor includes a three-microphone array, and the processor calculates an absolute wind speed based at least in part on a directional signal sent from the directional sensor and a wind speed signal sent from the wind speed sensor. In another embodiment, the processor calculates at least one of a windage uncertainty and a windage offset. In an embodiment, the processor displays at least one of the windage uncertainty and the windage offset.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1:
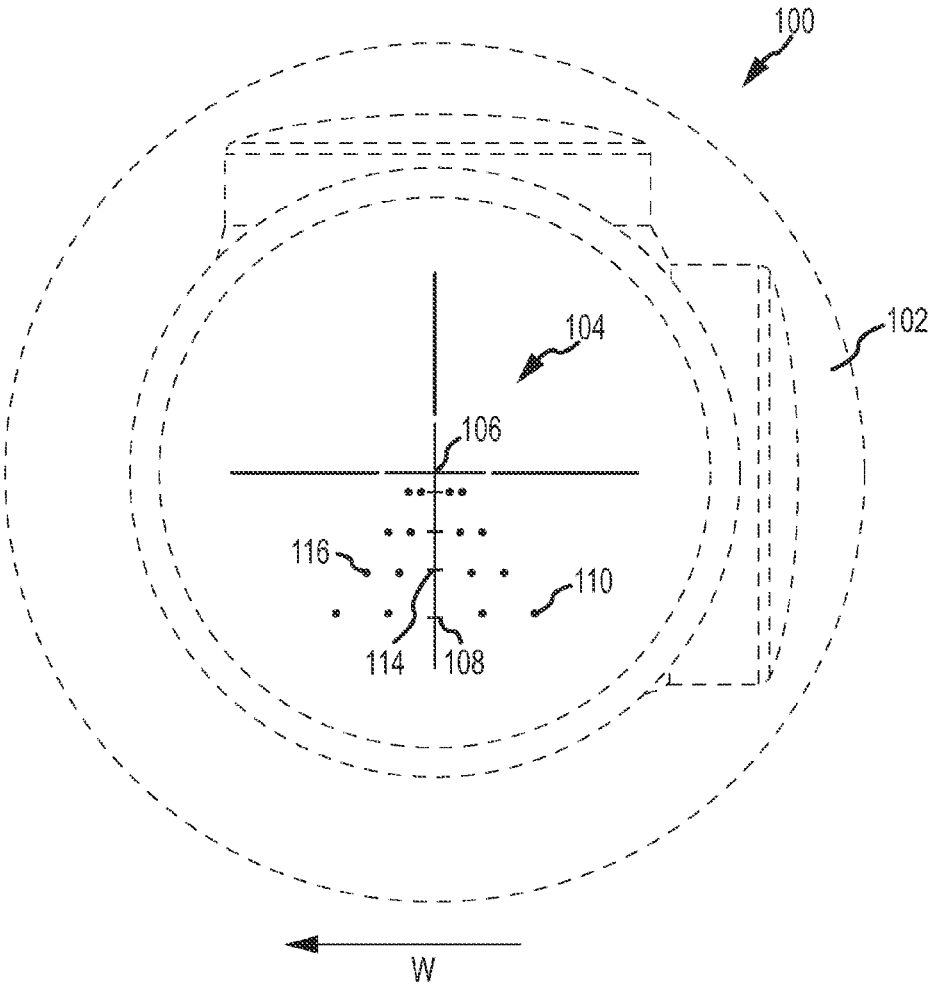
FIG.1 PRIOR ART
FIG. 1 is an end view of a prior art optical device.

The present technology relates to new and improved embodiments of known sighting systems and methods (such as those described in U.S. Pat. No. 7,703,679, the disclosure of which is hereby incorporated by reference herein in its entirety), for correctly aiming a firearm or other implement. In embodiments, the present sighting system includes a lens position sensor, which may also sense the position of a cam tube or power ring, a processor (CPU), and an aiming point that can be manipulated by the CPU either mechanically or electrically. Other embodiments may include an optic device, a range input, a controller/processor, an input system, a ballistics program, and an aiming element display device. The optic device is any device that can visually acquire a target, such as an optical scope (e.g., for a rifle, handgun, etc.), or a camera with a viewfinder. The range input may be input from a range finder that may be any device that can determine the distance between the sighting system and an intended target, such as a laser range finder, sometimes integrated with the optic device. Exemplary integrated optical devices and laser range finders include the 4x–12x–42 mm, LaserScope riflescope, as well as the Eliminator® riflescope, both available from Burris Corporation of Greeley, Colo. In other embodiments, the user may enter the range through the input system 306, described below.

The controller/processor accepts from the input system information, for example, information regarding the bullet and/or cartridge characteristics, rifle characteristics, any environmental considerations, and/or the magnification setting. After receiving the input from the input system, the controller/processor requires the range to determine the correct hold over offset needed. The range input provides the range to the target before the rifle is fired. In exemplary embodiments, a range finder, either integral to the optical device or separate from the optical device, or another input system, such as a handheld device, provides the range. Additionally, the controller/processor determines a present magnification setting of the optical device. The controller/processor determines the hold over adjustment and other corrections and automatically addresses or energizes the aiming element display device, as described below. The aiming point represents the point in the field of view of the optical device that should be positioned on the visually acquired target to correctly aim the rifle for the intended shot (expected point of impact). By aiming the rifle with the corrected aiming point, the rifleman can correctly aim the rifle for the target range, magnification setting, environmental conditions, cartridge characteristics, or other considerations, without needing to manually calculate corrections using graduated markings on the reticle crosshairs or making manual adjustments. In exemplary embodiments, the aiming point indicator is a crosshair on a vertical cross bar, a dot, a circle, a donut, a box, a triangle, or other possible visual representation of the aiming point.

Figure 2:
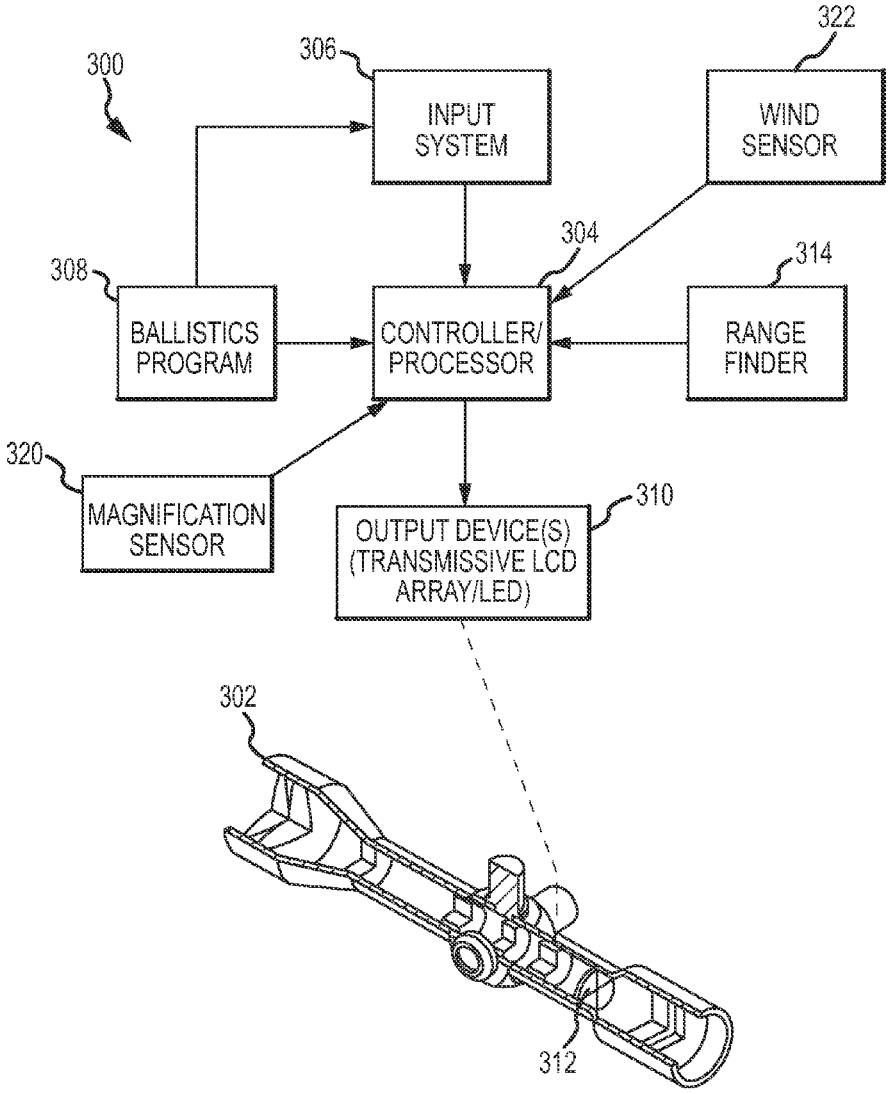
FIG. 2 is a schematic diagram of an optical device.

An exemplary sighting system 300 for visually acquiring a target and automatically providing a corrected aiming point in accordance with the present invention is shown in FIG. 2. As used herein, a "sighting system" shall be construed broadly and is defined as one or more optical devices and other systems that assist a person in aiming a firearm, a rifle or other implement. The sighting system 300 includes an optic device 302, such as a rifle scope or optical system attached to a firearm or other implement, an input system 306, a ballistics program 308, a controller/processor 304, and one or more output devices 310, such as an display element that projects an aiming point onto an element 316 located within an optical path of the sighting system. In further embodiments, the sighting system also includes a range input, such as from a range finder 314. Hereinafter, the optic device 302 will often be referred to as the rifle scope or scope, although the present technology is not limited to the use of a riflescope. Additionally, the implement or firearm will hereinafter be referred to as the rifle, although the present invention is not limited to use with rifles or other firearms. In embodiments, the riflescope 302 provides an etched reticle, as seen on lens 312, or vertical and horizontal crosshairs to aim the rifle as a backup aim point indicator in event of battery or other electronic problem, and also as a zeroing aim point.

The controller/processor 304 of the exemplary system 300 receives inputs or data from an input system 306 and a range input, such as a range finder 314 and is operable to execute a ballistics program 308 or receive information from the input system 306 pertaining to the ballistics program 308. The controller/processor 304 uses the input information to determine a correct aiming point for the scope 302. In embodiments, the controller/processor addresses or powers an aiming component 310, for example, a transmissive organic LED (OLED) array, in the riflescope 302. In the exemplary embodiment, the aiming component 310 includes a transmissive OLED array affixed to a plano lens 312 or, simply, a plano, which are defined as a piece of translucent material that has no refractive power. The aiming component may also, in some embodiments, include an LCD or LED that superimposes an image of aim point indication on the target image. Hereinafter, the aiming component will be described as an OLED array but one skilled in the art will recognize that other embodiments of the aiming component are possible.

Additionally, a magnification sensor 320 may be included that determines erector lens positions. A variety of sensors may be used, including those that sense and output the positions of the erecting lens, that sense and output the angular position of the cam tube, or that sense and output the angular position of the power (magnification) ring. For sensors 320 that provide position output, the output may be used to determine the change in erecting lens positions or their position relative to one another, from any magnification setting in relation to the predefined magnification setting or original erecting lens positions. The wind measuring technology disclosed herein may be used in conjunction with devices having aim point indication in either or both front and rear focal planes, and with fixed magnification devices. In certain embodiments, this can be mechanically done or electrically via the CPU. The CPU calculates to where in the field of view (FOV) the aiming point needs to be relocated. This may be calculated for a known range and ballistic information set. The optical device may also include a wind sensor 322, such as described below. The wind sensor sends signals to the controller 304, which incorporates those signals into calculations made to correct the aiming point for wind induced point of impact shift.

The controller/processor 304 is a hardware or combination hardware/software device that processes the input information to determine a correct aim point indication in the FOV. The controller/processor 304 conveys the correct location to the rifleman. This may be communicated by illuminating an appropriate aiming element on the display 310, or communicating the offset information by text or other method(s). In exemplary embodiments, the controller/processor 304 is a microcontroller or microprocessor, for example the 8-bit MCS 251 CHMOS microcontroller available from Intel® Corporation. In other embodiments, the controller/processor 304 is a custom-made, application specific integrated circuit or field programmable gate array that is operable to perform the functions described herein.

Figure 3:
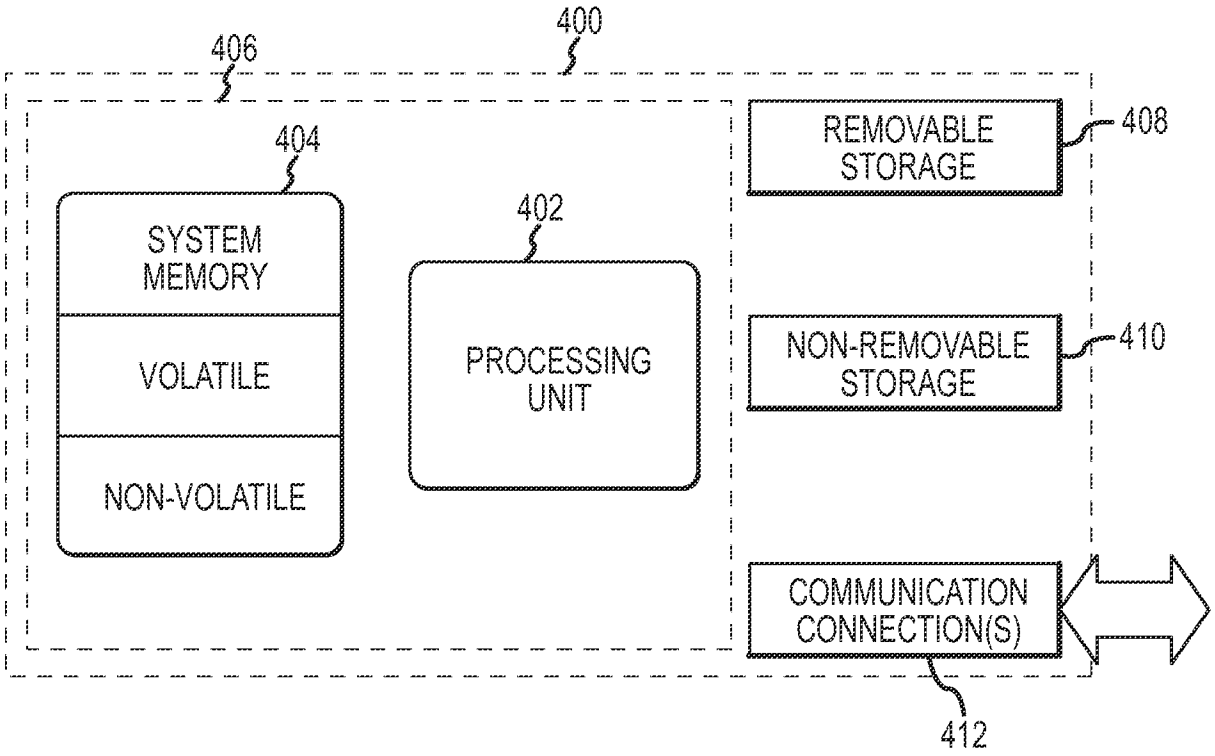
FIG. 3 is a schematic diagram of a controller processor for operating an optical device.

In embodiments, the controller/processor 304 includes any electronics or electrical devices required to perform the functions described herein. For example, an embodiment of a suitable operating environment in which the present technology may be implemented is shown in FIG. 3. The operating environment is only one example of a suitable operating environment and is not intended to suggest any limitation as to the scope of use or functionality of the technology. Other well-known controller/processor systems, environments, and/or configurations that may be suitable for use with the technology include, but are not limited to, hand-held devices, multiprocessor systems, microprocessor-based systems, programmable consumer electronics, or other computing environments that include any of the above systems or devices, and the like.

With reference to FIG. 3, an exemplary computing environment for implementing the embodiments of the controller/processor 304 (FIG. 2) includes a computing device, such as computing device 400. In its most basic configuration, computing device 400 typically includes at least one processing unit 402 and memory 404. Depending on the exact configuration and type of computing device 400, memory 404 may be volatile (such as RAM), non-volatile (such as ROM, flash memory, etc.), or some combination of the two. The most basic configuration of the controller/processor is illustrated in FIG. 3 by dashed line 406.

Additionally, device 400 may also have additional features/functionality. For example, device 400 may also include additional storage. Such additional storage is illustrated in FIG. 3 by removable storage 408 and non-removable storage 410. Such computer storage media includes volatile and nonvolatile, removable and non-removable media implemented in any method or technology for storage of information such as computer readable instructions, data structures, program modules, or other data. Memory 404, removable storage 408, and non-removable storage 410 are all examples of computer storage media. Computer storage media includes, but is not limited to, RAM, ROM, EEPROM, flash memory, or other memory technology. Any such computer storage media may be part of device 400.

Device 400 may also contain communications connection(s) 412 that allow the device to communicate with other devices. Communications connection(s) 412 is an example of communication media. Communication media typically embodies computer readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media.

Computing device 400 typically includes at least some form of computer readable media, which can be some form of computer program product. Computer readable media can be any available media that can be accessed by processing unit 402. By way of example, and not limitation, computer readable media may include computer storage media and communication media. Computer storage media includes volatile and nonvolatile, removable and nonremovable media implemented in any method or technology for storage of information such as computer readable instructions, data structures, program modules, or other data. Combinations of any of the above should also be included within the scope of computer readable media.

In embodiments, one form of computer readable media that may be executed by the controller/processor 304 is the ballistics program 308, as shown in FIG. 2. The ballistics program 308 is any data and/or executable software instructions that provide ballistics information. For example, the ballistics program is the Infinity Suite of exterior ballistics software offered by Sierra Bullets of Sedalia, Miss. Ballistics information is generally defined as any data or information that describes the flight of a projectile, such as a bullet under the influence of environmental, gravitational, or other effects. The ballistics information may be based on information received about the mass of the bullet, the bullet's coefficient of drag or other ballistic coefficients, the muzzle velocity, humidity, barometric pressure, wind velocity, wind direction, altitude, angle of the shot, range, diameter of the bullet, and other considerations. As one skilled in the art will recognize, some or all of this input information can be used to determine characteristics of a bullet's flight. In other embodiments, a ballistics program calculates ballistics information, which is provided in a look-up table. Thus, rather than calculate the ballistics information, a set of ballistics information is pre-calculated and used by the processor/controller 304.

Figure 4:
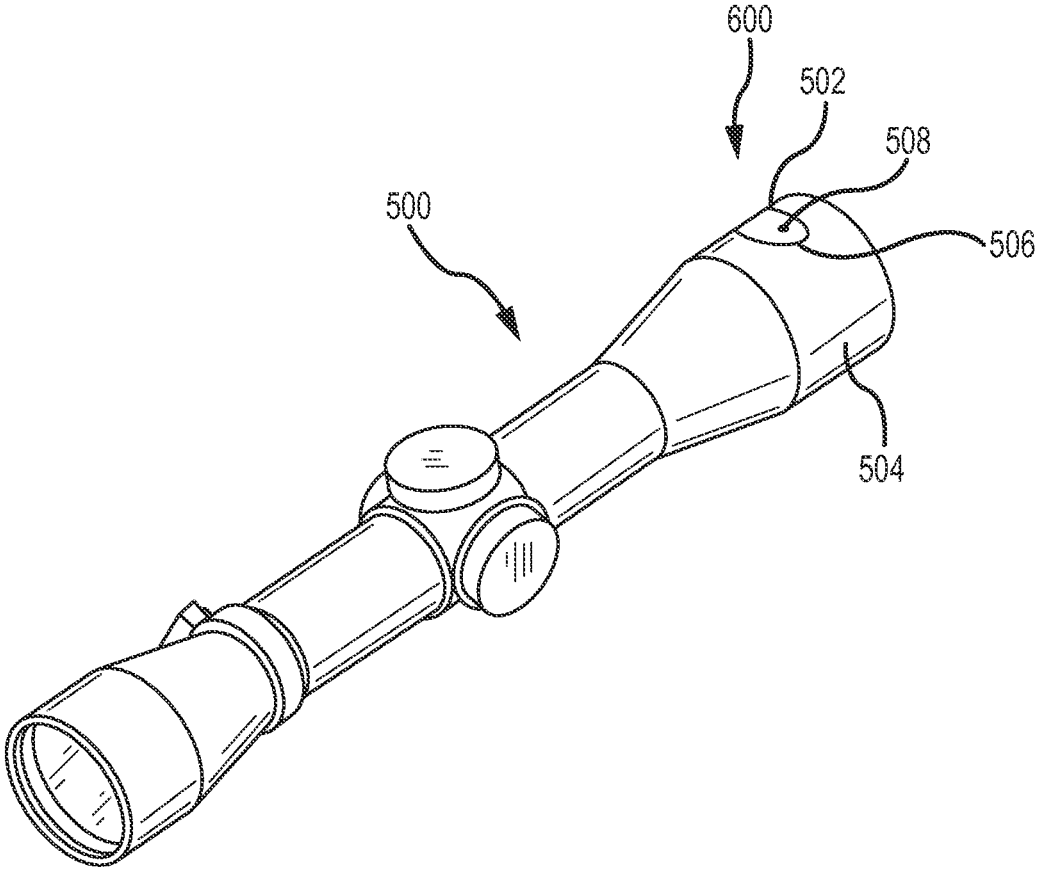
FIG. 4 is perspective view of an optical device.

FIG. 4 depicts a riflescope 500 that includes a wind measurement system 502, in this example, mounted on a forward bell 504 of the housing of the riflescope 500. Various types of wind measurement systems and devices 502, such as anemometers, may be mounted on a riflescope 500. However, the size and durability must be considered during selection. Riflescopes are subject to a significant amount of abuse in the field, as they may be carried through brush, subjected to adverse weather conditions, and potentially dropped. Additionally, firearms and riflescopes are of a fairly small size, thus requiring a wind measurement system of an appropriate size. The anemometer may be a cup anemometer, a wind vane anemometer, a hot wire anemometer, a laser Doppler anemometer, a Doppler LIDAR anemometer, a sonic anemometer, or a tube anemometer. The embodiment depicted in FIG. 4 is a sonic anemometer, which includes a microphone array 600 mounted to a plate or other support structure 506.

Figure 5A:
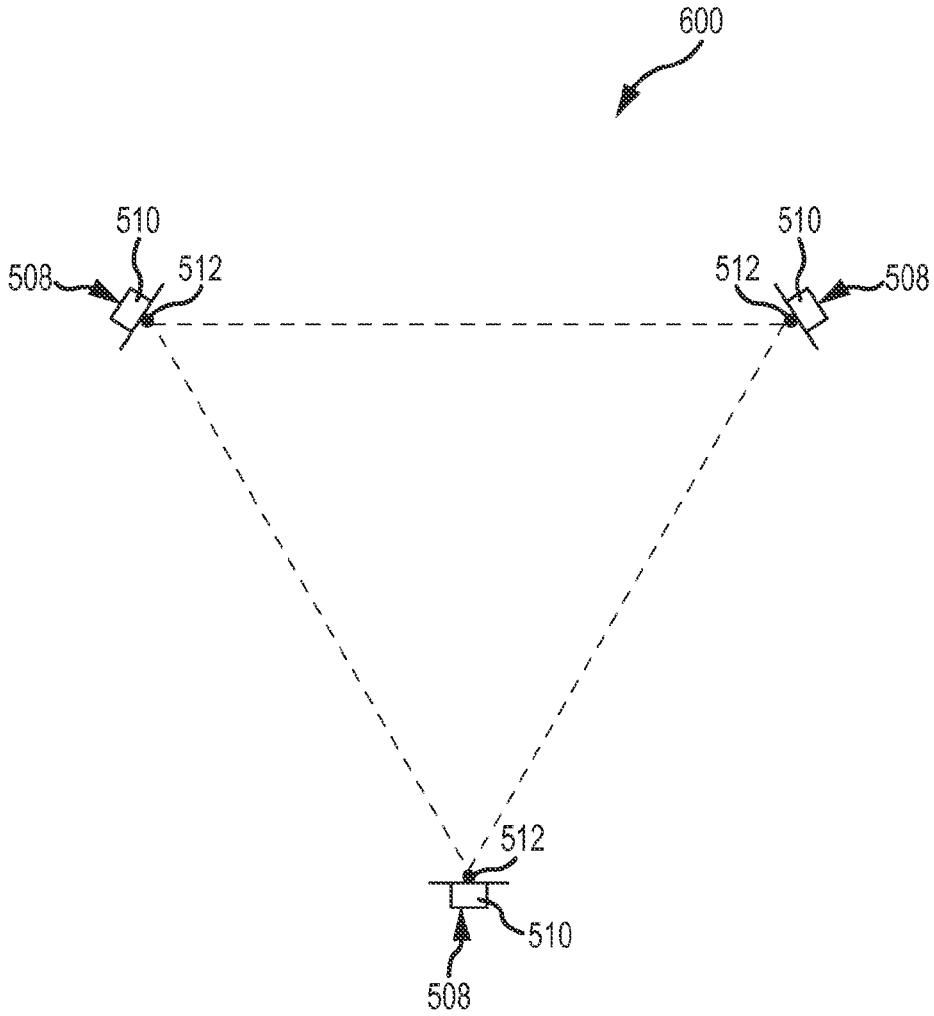
FIG. 5A is a schematic diagram of a wind measuring system.

Each microphone element 508 includes a speaker element 510 and a pickup 512 element (i.e., a sound receiver element), as depicted in FIG. 5A. The microphone array 600 includes at least three microphone elements 508 mounted in a substantially triangular arrangement to the plate 506. The speaker element 510 is located proximate the pickup element 512, and may be located above, below, or to the side thereof. It is advantageous if the speaker element 510 is acoustically isolated from the pickup element 512, due to the close spacing required of the array 600. In certain embodiments, for example, the distance between the adjacent microphone elements 508 is about 10 mm. Other distances are contemplated.

The microphone elements 508 may utilize piezoelectric crystals. In certain embodiments, a single crystal may be used as either a speaker or a microphone. In another embodiment of the array depicted in FIG. 5A, the array may include three microphones in an equilateral triangle, with a speaker in the middle of the triangle. Absolute wind direction (in two dimensions) may be calculated by determining the Doppler shift of the pickup relative to the device. Piezoelectric crystal arrays typically use the crystals only in the corners. One of the crystals may send a ping or sound pulse, and the two remaining crystals measure the signal. Thereafter, a signal may be sent through a different crystal and sensed at the two remaining crystals.

Figure 5B:
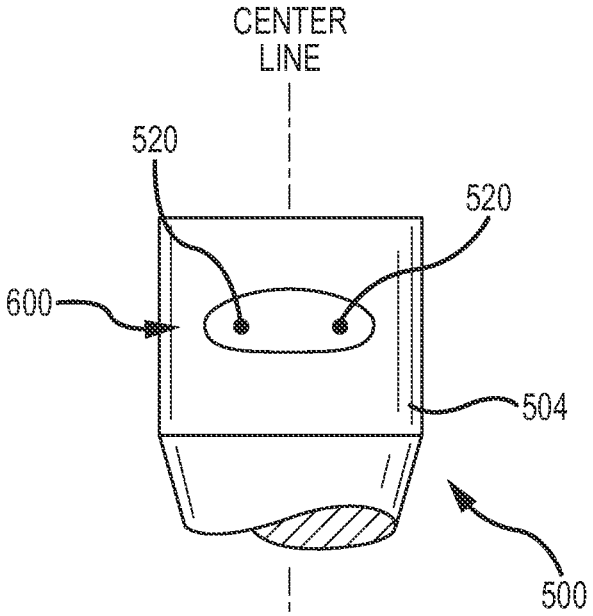
FIGS. 5B and 5C are schematic diagrams of wind measuring systems.
Figure 5C:
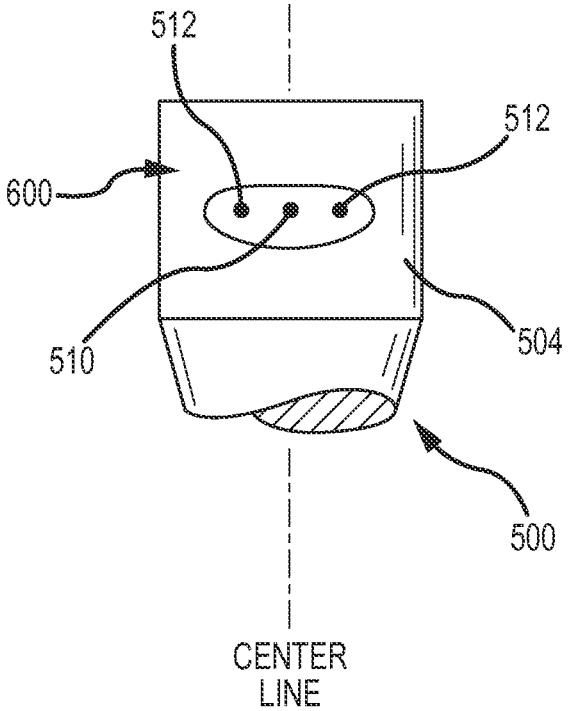

The effect of wind on bullet flight is primarily a function of the vector component significantly perpendicular to line of sight and projectile path. A very effective wind sensor 600 for a rifle scope 500 is made that only measures wind speed perpendicular to a centerline of the scope 500. This embodiment may utilize only two crystals 520 perpendicular to the scope centerline, as depicted in FIG. 5B. In an embodiment depicted in FIG. 5C, a speaker element 510 and two pickup elements 512, one on each side, are utilized. Multiple wind measurements may be averaged and may be arranged to be more advantageous than a single instantaneous measurement. This may be especially true if a shot is taken a significant time after an initial instantaneous measurement is made. Constantly calculating wind speed and updating the display accordingly for each makes reading the displayed or using the aiming point difficult and impractical. This is especially true in gusty conditions. Accordingly, certain embodiments weigh the average toward recent measurements. Additionally, the device may detect wind gust frequency and severity and calculate an "intelligent" average.

Once a target is identified by the rifleman, the scope is aimed and a button pressed to get a correct range reading. In certain embodiments of the scope, if a range is taken, the aiming indicator is displayed for about 90 seconds. If wind is first measured at the time of the range reading, some time may pass before the aiming dot is visible. In that period of time, the wind sensor may take a plurality of wind measurements and calculate the required wind offset. The offset may be changed multiple times per second to an updated average. Normally, the average varies less as time increases. Re-ranging may be required if some time has elapsed and no shot has been taken. The device may store the wind data with "time stamp" information and, if appropriate, use all or some of it to steady the average. A significant difference between old and new data may result in ignoring of the old data. In some embodiments, the device may also determine an absolute wind direction utilizing an electronic compass or GPS chip or other device. Rifle direction information may also be saved along with the time and wind data. This information may also be evaluated and weighted based on the amount of change in rifle direction, inclination, time change, and or other condition changes.

Data related to absolute wind direction may also be stored to provide maximum or minimum or point of aim confidence information to the shooter. The information can be provided as textual information such as "Max=" and "Min=" in terms of horizontal angle displayed on the reticle such as MOA or Mils. Thus, a windage uncertainty could be displayed (such as ±0.5 Mils) along with a windage offset (such as 1.6 Mils). Alternatively or additionally, the actual aiming mark could be modified to show wind uncertainty or max/min aiming offset by having a horizontal line through the aim point indication or a horizontally elongating the aim point indicator.

Due to the small overall size of the wind measurement array 600, it may be advantageous if the various elements of the array 600 are configured and operated such that outside noise is reduced. Outside noise may lead to inaccurate wind speed calculations. A number of different technologies are contemplated to address this issue. For example, each of the speaker elements 510 are acoustically isolated from the pickup elements or other elements being used for pick up 512. In that case, each speaker element 510 and pickup element 512 of each of the microphone elements 508 are all isolated from each other. Additionally, each of the microphone elements 508 are isolated from the material of the riflescope housing. Isolation may be accomplished by utilizing vibration absorbing elastomers. These or other materials do not have an insignificant adverse impact on the sound signals sent by the speaker elements 510 through the air.

Additionally, selection of sound signal frequency, pulse duration, and other waveform characteristics may be optimized to reduce auditory noise. Frequencies and pulse durations may be selected for a particular application (riflescope or pistol scope), environment (outdoor game shooting or indoor target shooting), etc. In general, however, frequencies that are inaudible to humans and non-human animals are desirable, as they may not distract the rifleman or alert a target animal of the rifleman's presence. It has been determined that such frequencies may be in the ULF or UHF bands. Additionally, sound signal pulse duration may also be limited to a series of discrete or individual pulses. In certain embodiments of the optical device described herein, a single sound signal may be emitted from one of the speaker elements 510 when the riflemen presses a button located on the device for activating the laser rangefinder 314.

Since each microphone element 508 includes both a speaker element 510 and a pickup element 512, the controller 304 may select which of the three available speaker 510 and pickup elements 512 may be used for a given calculation. In one embodiment, a single element, such as a piezoelectric element may be used to perform the functions of both the speaker element and the pickup element. In one embodiment, the speaker element 510 located proximate the rifleman may be used to emit sound, while the pickup elements 512 on the distal microphone elements 508 may be used to receive the emitted sound signal. Thereafter, the received sound signal may be processed by the controller 304 to determine the wind speed and (optionally) direction. In alternative embodiments, a single sound signal may be sent by each of the three available speaker elements 510, sequentially. The resulting received signals may be processed, then the information related thereto averaged to determine a wind speed and direction. This embodiment may be helpful in identifying speakers 510 or pickup elements 512 that are not functioning properly.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. An optical device comprising:

a housing containing a plurality of lenses, wherein at least one of the lenses comprises a reticle;

an output device;

a processor located in the housing; and a wind speed sensor mounted to the housing and configured to send (a) a wind speed signal corresponding to a wind speed to the processor, and (b) an updated wind speed signal corresponding to an updated wind speed to the processor;

wherein the processor calculates a wind speed based at least in part on the wind speed signal, and wherein the processor sends an output signal corresponding to the calculated wind speed to the output device, and wherein the processor calculates an updated wind speed based at least in part on the updated wind speed signal, and wherein the processor sends an updated output signal corresponding to the calculated updated wind speed to the output device.

2. The optical device of claim 1, wherein the output device comprises an addressable display and the output signal comprises a display signal comprising at least one of a numerical value and an aiming point.

3. The optical device of claim 1, wherein the wind speed sensor comprises an anemometer.

4. The optical device of claim 1, wherein the anemometer comprises at least one of a velocity anemometer, pressure sensor, a cup anemometer, a wind vane anemometer, a hot wire anemometer, a laser Doppler anemometer, a Doppler LIDAR anemometer, a sonic anemometer, and a tube anemometer.

5. The optical device of claim 1, further comprising a wind direction sensor.

6. The optical device of claim 1, wherein the wind speed sensor comprises a microphone array.

7. The optical device of claim 6, wherein the array comprises at least two microphone elements, each microphone element comprising a speaker element and a pickup element.

8. The optical device of claim 7, wherein the speaker element is acoustically isolated from the pickup element.

9. The optical device of claim 6, wherein the microphone array delivers a sound having a frequency outside the audible range of a non-human animal.

10. The optical device of claim 9, wherein the microphone array comprises:

a speaker element;

a first pickup element; and a second pickup element, wherein the first pickup element and the second pickup element are acoustically isolated from the speaker element, and wherein the speaker element emits a single sound signal, and wherein the first pickup element and the second pickup element each receive the single sound signal, and wherein the processor calculates a wind speed and direction based at least in part on that single sound signal.

11. The optical device of claim 6, microphone array emits a sound signal having at least one of a frequency characteristic and a pulse characteristic that each reduce noise.

12. An optical device comprising:

a housing containing a plurality of lenses, wherein at least one of the lenses comprises an addressable element;

a processor located in the housing; and a wind speed sensor mounted to the housing and configured to send a wind speed signal corresponding to a wind speed to the processor;

wherein the processor calculates a wind speed based at least in part on the wind speed signal, and wherein the processor averages a plurality of calculated wind speeds over a time to determine an average wind speed, and wherein the processor sends an address signal to the addressable element, and wherein the address signal is based on at least one of the wind speed and the average wind speed.

13. The optical device of claim 12, wherein the average wind speed is weighted over the time in favor of recent measurements.

14. The optical device of claim 12, further comprising measuring a wind gust speed and a wind variation severity.

15. The optical device of claim 12, wherein the processor stores a wind speed and a time associated with the wind speed.

16. The optical device of claim 15, further comprising a directional sensor for detecting a gun orientation, wherein the wind speed sensor comprises a three-microphone array, and the processor calculates an absolute wind speed based at least in part on a directional signal sent from the directional sensor and a wind speed signal sent from the wind speed sensor.

17. The optical device of claim 16, wherein the processor calculates at least one of a windage uncertainty and a windage offset.

18. The optical device of claim 17, wherein the processor displays at least one of the windage uncertainty and the windage offset.

* * * * *